US007021030B1

(12) United States Patent
Burns

(10) Patent No.: US 7,021,030 B1
(45) Date of Patent: Apr. 4, 2006

(54) SYSTEM FOR RECOVERING AND RECYCLING UNUSED TOILET TISSUE AND METHOD OF USE AND MANUFACTURE THEREOF

(76) Inventor: Arthur Dale Burns, 10460 Roosevelt, No. 133, St. Petersburg, FL (US) 33716

( * ) Notice: Subject to any disclaimer, the term of this patent is extended or adjusted under 35 U.S.C. 154(b) by 131 days.

(21) Appl. No.: 10/268,226

(22) Filed: Oct. 10, 2002

(51) Int. Cl.
*B65B 11/00* (2006.01)

(52) U.S. Cl. ..... 53/461; 53/425; 242/538

(58) Field of Classification Search ..... 53/425, 53/461; 242/523, 550, 554, 556, 538
See application file for complete search history.

(56) References Cited

U.S. PATENT DOCUMENTS 2,794,606 A * 6/1957 Miller ..... 242/422.4
3,393,105 A * 7/1968 Tellier, Jr. ..... 156/187
3,726,744 A * 4/1973 Whiteman ..... 156/502
3,977,618 A * 8/1976 Kato et al. ..... 242/554
3,989,576 A * 11/1976 Collin et al. ..... 156/361
4,280,669 A * 7/1981 Leanna et al. ..... 242/527.1
4,580,738 A * 4/1986 Scheer ..... 242/422.5
5,242,525 A * 9/1993 Biagiotti ..... 156/357
5,301,883 A * 4/1994 Lukaart ..... 242/534.2
5,468,321 A * 11/1995 Van Liempt et al. ..... 156/159
5,533,688 A * 7/1996 Pace ..... 242/413.2
5,716,489 A * 2/1998 Biagiotti ..... 156/443
5,794,870 A * 8/1998 Langlie ..... 242/538.2
6,372,064 B1 * 4/2002 Butterworth et al. ..... 156/64
6,503,326 B1 * 1/2003 Mikelionis ..... 118/419

* cited by examiner

*Primary Examiner*—Rinaldi I. Rada
*Assistant Examiner*—Brian Nash

(57) ABSTRACT

The present invention provides for a system for recovering and recycling unused toilet tissue from partially used toilet tissue rolls. In one embodiment, the system is comprised of (1) a hopper for the collection of at least one partially used roll of toilet tissue, the hopper positioning the partially used roll for de-spooling; and (2) a de-spooling and re-spooling apparatus coupled to the hopper, the apparatus de-spooling the toilet tissue from the core of the partially used roll of toilet tissue and re-spooling the toilet tissue onto a recycled toilet tissue roll.

12 Claims, 1 Drawing Sheet

SYSTEM FOR RECOVERING AND RECYCLING UNUSED TOILET TISSUE AND METHOD OF USE AND MANUFACTURE THEREOF

TECHNICAL FIELD OF THE INVENTION

The present invention is directed, in general, to a recycling system and, more specifically, to a system for recovering and recycling unused toilet tissue from partially used toilet tissue rolls.

BACKGROUND OF THE INVENTION

Once the thought occurs, even the most casual observer has to be impressed by the enormous waste of unused toilet tissue at high density locations such as hotels and stadiums. Such waste is certainly a cost factor in the operation of such locations, as evidenced by some of the gadgets and other devices being used that are designed to limit or restrict a user's access to toilet tissue.

One enormous source of waste is the replacement of partially used rolls of toilet tissue with new rolls followed by the disposition of the partially used rolls that are discarded along with the trash and other garbage. It is frequently the policy of an institution to replace a roll of toilet tissue that is partially used with a full roll, even if only a few sheets have been removed. Thus, it is evident that a considerable amount of perfectly good unused toilet tissue is being discarded each and each day.

In addition to the obvious financial waste in disposing of a perfectly good and useable product, are issues and concerns are involved. In many cases the unused rolls of toilet tissue end up in land-fills that are already space limited. In addition, like many paper products, toilet tissue is generally a product of the forest. To the extent the product is not fully used, it requires the use of more trees in the forest to replace it.

A number of prior art devices have been developed to conserve toilet tissue. These include many devices designed as dispensers that limit the amount of toilet tissue that can be removed at one time. Another conservation technique the use a dispensers that take oversized rolls, thus permitting more of the roll to be used before the tail end of the roll is ready to be discarded. All of these devices seem to work to a moderate degree, but using such devices is not appropriate for all occasions. Although no one minds a service station or convenience store installing one of the typical conservation devices, everyone objects if a hotel or motel attempts to use such a device.

It would be interesting to determine, assuming appropriate data was available, how much land fill could be saved, how many trees could be conserved and how much capital would be made available for other purposes, if the waste from the disposition of so much unused toilet tissue could be eliminated or, at least, reduced.

Accordingly, what is needed in the art is a system for recovering and recycling unused toilet tissue from partially used toilet tissue rolls.

SUMMARY OF THE INVENTION

To address the above-discussed deficiencies of the prior art, the present invention provides a system for recovering and recycling unused toilet tissue from partially used toilet tissue rolls. In one embodiment, the system is comprised of (1) a hopper for the collection of at least one partially used roll of toilet tissue, the hopper positioning the partially used roll for de- spooling; and (2) a de-spooling and re-spooling apparatus coupled to the hopper, the apparatus de-spooling the toilet tissue from the core of the partially used roll of toilet tissue and re-spooling the toilet tissue onto a recycled toilet tissue roll.

The present invention thus provides a system that can be beneficially used by janitorial services or janitorial departments for hotels, office buildings, stadiums, airports and other high population density areas for the salvage of unused toilet tissue from partially used rolls of toilet tissue. Frequently, partially used rolls of toilet tissue are discarded by the janitorial staff at high density population areas such as those listed above. The present invention permits the salvage and reuse of this commodity that would otherwise discarded together with the other trash collected for discharge.

One embodiment of the invention provides for an end of the partially used roll of toilet tissue to be glued to the recycled toilet tissue roll. This embodiment is intended to be within the scope of the present invention whether such end is glued directly to the core of the recycled roll or to an end of the salvaged toilet tissue already spooled onto such roll.

In another embodiment of the invention, a plurality of partially used toilet tissue rolls are collected in the hopper. In still another embodiment the recycled toilet tissue roll is provided with a new core. Thus, the present invention includes an apparatus that provides a new core to be used for spooling unused toilet tissue from a partially used roll or a plurality of partially used rolls until a complete recycled roll of toilet tissue is recovered and put into use.

In yet still another embodiment of the invention, the recycled toilet tissue roll is disinfected and sterilized. Another aspect of the invention provides that the recycled toilet tissue roll is wrapped. In yet still another aspect, a plurality of recycled toilet tissue rolls are packaged. Thus, the present invention provides embodiments for gathering partially used toilet tissue rolls, spooling the toilet tissue from such rolls onto a new core, disinfecting and sterilizing the newly recycled rolls, and wrapping and packaging the rolls so that the recycled tissue can be put into service.

The present invention also provides for a method of manufacturing a system for recovering and recycling unused toilet tissue from partially used toilet tissue rolls as well as a method for recovering and recycling unused rolls of toilet tissue. The following information will be sufficient to enable one of ordinary skill in the pertinent art to practice the foregoing methods.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
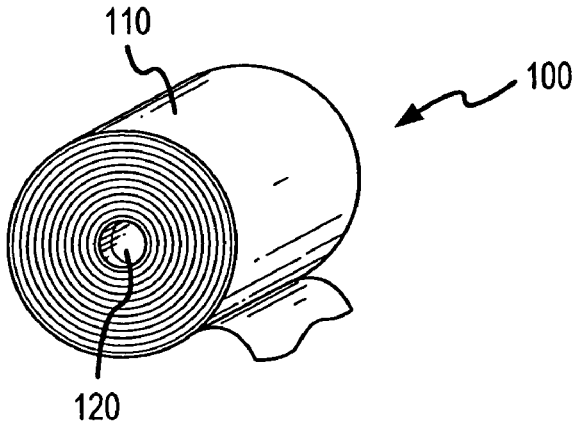
FIG. 1 illustrates an isometric view of an embodiment of a partially used roll of toilet tissue spooled around a core.

Referring initially to FIG. 1, illustrated is an isometric view of an embodiment of a partially used roll 100 of toilet tissue 110 spooled around a core 120. This is a typical roll 100 of the kind removed and discarded daily at a large number of high use buildings and institutions. In most cases the partially used roll 100 is placed in a trash receptacle where it is hauled to a land-fill together with the rest of the trash and garbage. Frequently only an insignificant amount of toilet tissue 100 has been removed from the roll 100 before it is discarded.

Figure 2:
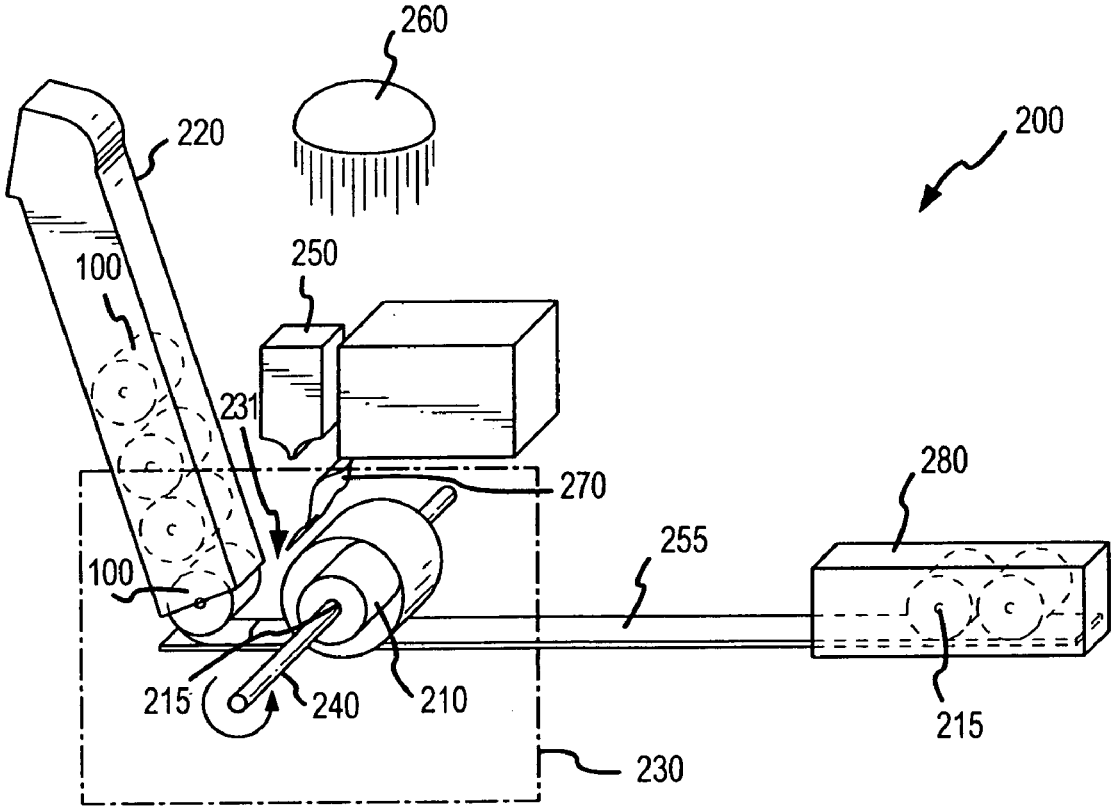
FIG. 2 illustrates a side view of an embodiment of a system constructed in accordance with the present invention for salvaging unused toilet tissue by removing it from a partially used roll and re-spooling it onto a recycled toilet tissue roll.

Turning now to FIG. 2, illustrated is a side view of an embodiment of a system 200 constructed in accordance with the present invention for salvaging unused toilet tissue 110 by removing it from a partially used roll 100 and re-spooling it onto a recycled toilet tissue roll 210. The system 200 provides a hopper 220 for the collection of at least one partially used roll 100 of toilet tissue 110, although in one embodiment of the invention a plurality of partially used rolls 100 can be placed in the hopper 220. After a roll 100 is placed in the hopper 220, the roll 100 is placed in a position so that the unused toilet tissue 110 can be removed or de-spooled from the core 120. A roll 100 can be positioned for de-spooling by the type of hopper 220 (such as that illustrated where each roll 100 is hand fed), the shape of the hopper 220 (a funnel shape, for example, would only permit room at the bottom of the funnel for one roll 100), a handling mechanism coupled to the hopper 220, or by vibratory action of the hopper 220 to shake a roll 100 into position, all of which are within the intended scope of the present invention.

After the partially used roll 100 of toilet tissue 110 is positioned, a de-spooling and re-spooling apparatus 230 coupled to the hopper 220 is used to de-spool the unused toilet tissue 110 from the core 120 of the partially used roll 100 and re-spool it onto a recycled toilet tissue roll 210. There are a number of devices and combinations of devices that can be used for de-spooling and re-spooling. Perhaps the simplest such device is a rotating spindle 240 that engages the core 215 of the recycled roll 210 and spins it in the proper direction to remove unused toilet tissue 110 from the partially used roll 100 and spin it onto the recycled roll 210. Such a spindle 240 cam be turned by a motor or it could even be hand turned, in either case it would be within the intended scope of the present invention.

One embodiment of the invention provides for an end of toilet tissue 110 from a partially used roll 100 to be glued to the recycled roll 210. Of course such embodiment also includes gluing the end to the salvaged toilet tissue 110 already on the recycled roll 210. The glue can be applied manually or by using a glue applicator 250 coupled to the system 200. Such a glue applicator 250 can be structured to work in a number of different ways, all of which are within the intended scope of the present invention. It may, for example, use a spray head to apply glue or it use a spring loaded applicator that applies glue by contact when a new partially used roll 100 makes its way down the hopper 220 for de-spooling. In still another embodiment the glue may actually consist of a thin perforated tape used to fasten the end of toilet tissue 110 on the partially used roll 100 to the recycled roll 210 end. Regardless of the method or mechanism used to apply glue, all such methods and mechanisms, whether now known or later discovered, are within the intended scope of the present invention.

While the system 200 can use an existing partially used roll 100 to start a new recycled roll 210, in one embodiment of the invention the recycled roll 210 is provided with a new core 215. This obviates potential operational problems with the de-spooling and re-spooling apparatus 230 which could jam the apparatus 230 if a core 120 of a partially used roll 100 was frayed or crushed. A new core 215 can be located on the de-spooling and re-spooling apparatus 230 either by hand placement when a recycled roll 210 is started or it could be located by using established technology, such as one of the well known "pick and place" machines. Once the new core 215 is in position, unused toilet tissue 110 will be removed from partially used rolls 100 until a recycled roll 210 is completed.

Before a recycled roll 210 of toilet tissue 110 is placed in service, it must be disinfected and sterilized. In one embodiment of the present invention, provision is made for disinfecting and sterilizing recycled rolls 210 of toilet tissue 110. There are a number of procedures, processes and methods for disinfecting and sterilizing paper that are well known to those of ordinary skill in the pertinent art. The method illustrated in FIG. 2 provides for the use of ultra-violet light from a light fixture 260 that disinfects and sterilizes the toilet tissue 110 as it is being de-spooled and re-spooled. Of course, any other method used to disinfect and sterilize recycled rolls 210, such as heat or chemicals, is within the intended scope of the present invention.

Once a recycled roll 210 of toilet tissue is completed it is ready to be placed in service. However, handling is easier, as is storage, if the recycled roll 210 is wrapped, as provided for in one embodiment of the invention. In the illustrated embodiment, when a roll 210 is filled to the desired level, the partially used roll 100 feed from the hopper 220 is shut down while a wrapper 270 is fed onto the re-spooling side 231 of the de-spooling and re-spooling apparatus 230 where it is spooled onto the recycled roll 210 as a wrap 270. Of course, there are a number of devices that can be employed to wrap recycled rolls 210, all of which are within the intended scope of the present invention.

Once recycled rolls 210 are wrapped they are again in condition for storage and inventory. However, it is more convenient to handle large volumes of such rolls 210 if several rolls 210 are combined into a package 280. Such a package 280 can consist of any number of rolls 210, although it appears that packages 280 containing a number of rolls 210 divisible by four are standard. As was the case with the wrapping of rolls 210, there are a number of devices and methods that can be used to package rolls 210. In the illustrated embodiment, a packaging container 280 is placed over the end of a conveyor 275. Once the desired number of rolls 210 have accumulated in the packaging container 280, the container 280 is removed and secured.

Thus the present invention provides a system for reusing partially used rolls of toilet tissue that would otherwise be discarded. The tissue is spooled onto a new core and, in some embodiments, wrapped and packaged after which it is placed back in service. The present invention thus provides a system that can be beneficially used by janitorial services or janitorial departments for hotels, office buildings, stadiums, airports and other high use areas, that reduces waste and saves money. In addition, several beneficial environmental factors are also derived from the present invention, including the reduction of land fill waste and the preservation of forest products that would otherwise be used in the manufacture of toilet tissue.

The present invention also provides for a method of manufacturing a system for recovering and recycling unused toilet tissue from partially used toilet tissue rolls as well as a method for recovering and recycling unused rolls of toilet tissue. The foregoing information is described in sufficient detail to enable one of ordinary skill in the pertinent art to practice these methods.

Although the present invention has been described in detail, those skilled in the art should understand that they can make various changes, substitutions and alterations herein without departing from the spirit and scope of the invention in its broadest form.

What is claimed is:

1. A system for recovering and recycling unused toilet tissue, comprising:

a hopper suitable for the collection of a plurality of partially used toilet tissue rolls, said hopper positioning said partially used toilet tissue rolls for de-spooling; and means for de-spooling said toilet tissue from the core of each of said partially used toilet tissue rolls and re-spooling said toilet tissue onto a recycled toilet tissue roll, wherein said means is coupled to said hopper.

2. The system as recited in claim 1 wherein an end of each of said partially used toilet tissue rolls is glued to said recycled toilet tissue roll.

3. The system as recited in claim 1 wherein said recycled toilet tissue roll is provided with a new core.

4. The system as recited in claim 1 further comprising said apparatus disinfecting and sterilizing said recycled toilet tissue roll.

5. The system as recited in claim 1 further comprising said apparatus wrapping said recycled toilet tissue roll.

6. The system as recited in claim 1 further comprising said apparatus packaging a plurality of said recycled toilet tissue roll.

7. A method of manufacturing a system for recycling unused toilet tissue, comprising:

providing a hopper suitable for the collection of a plurality of partially used toilet tissue rolls, said hopper configured to position said partially used toilet tissue rolls for de-spooling; and coupling a de-spooling and re-spooling apparatus to said hopper, said apparatus suitable for de-spooling said toilet tissue from each core of said plurality of partially used toiled tissue rolls and re-spooling said toilet tissue onto a recycled toilet tissue roll.

8. The method as recited in claim 7 wherein an end of each of said plurality of partially used toilet tissue rolls is glued to said recycled toilet tissue roll.

9. The method as recited in claim 7 wherein a new core is provided for said recycled toilet tissue roll.

10. The method as recited in claim 7 wherein said recycled toilet tissue roll is disinfected and sterilized.

11. The method as recited in claim 7 wherein said recycled toilet tissue roll is wrapped.

12. The method as recited in claim 7 wherein a plurality of said recycled toilet tissue rolls are packaged.

* * * * *